US008989418B2

(12) United States Patent
Dahl

(10) Patent No.: US 8,989,418 B2
(45) Date of Patent: Mar. 24, 2015

(54) EAR DEVICE FOR IMPROVED FIT AND SOUND

(71) Applicant: Linda D. Dahl, New York, NY (US)

(72) Inventor: Linda D. Dahl, New York, NY (US)

( * ) Notice: Subject to any disclaimer, the term of this patent is extended or adjusted under 35 U.S.C. 154(b) by 212 days.

(21) Appl. No.: 13/732,775

(22) Filed: Jan. 2, 2013

(65) Prior Publication Data

US 2013/0121518 A1 May 16, 2013

Related U.S. Application Data

(63) Continuation-in-part of application No. 12/038,434, filed on Feb. 27, 2008, now Pat. No. 8,391,526.

(51) Int. Cl.

| | |
|---|---|
| ***H04R 25/00*** | (2006.01) |
| ***H04R 25/02*** | (2006.01) |
| ***H04R 1/10*** | (2006.01) |

(52) U.S. Cl.

CPC ..... *H04R 25/02* (2013.01); *H04R 1/10* (2013.01); *H04R 1/1008* (2013.01); *H04R 1/1016* (2013.01); *H04R 25/656* (2013.01); *H04R 25/658* (2013.01)

USPC ..... 381/328; 381/322

(58) Field of Classification Search

USPC ..... 381/328

See application file for complete search history.

(56) References Cited

U.S. PATENT DOCUMENTS

| | | | | |
|---|---|---|---|---|
| 5,659,156 | A * | 8/1997 | Mauney et al. | 181/130 |
| 2004/0096077 | A1 * | 5/2004 | Csensich et al. | 381/328 |
| 2005/0111686 | A1 * | 5/2005 | Bayer | 381/330 |
| 2005/0169492 | A1 * | 8/2005 | Topholm | 381/322 |
| 2009/0123010 | A1 * | 5/2009 | Cano et al. | 381/318 |

* cited by examiner

*Primary Examiner* — Christopher Uhlir

(74) *Attorney, Agent, or Firm* — Triangle Patents, PLLC

(57) ABSTRACT

The present invention is directed to an in-the-ear device sized and shaped such that the in-the-ear device universally and ergonomically fits into the human ear without slipping out and providing the user with a comfortable fit. The in-the-ear device is secured in the user's ear taking advantage of the natural curvature of the human to provide support and shift the center of gravity from outside the ear to further inside the pinna to prevent the device from slipping out while retaining a high level of comfort.

19 Claims, 5 Drawing Sheets

Right side
21
20
22
17
10
15
25
30

3/4
21
20
22
30
15
11
25

Top
20
21
17
30

Front
20
21
17
22
33
30

20
22
17
15
30
33
50
53

121
100
130

117

125
121

120

121

EAR DEVICE FOR IMPROVED FIT AND SOUND

CROSS-REFERENCES TO RELATED APPLICATIONS

This application claims priority from, and is a continuation-in-part of, application Ser. No. 12/038,434, filed Feb. 27, 2008, which is incorporated herein by reference in its entirety.

BACKGROUND OF THE INVENTION

1. Field of the Invention

The present invention relates generally to a device shaped to the outer ear for improving the sound quality and fit of various portable ear phones and sound producing equipment. Specifically, the invention is directed to anatomically fitted shells designed to fit securely inside the external ear and provide improved acoustics without the need to maximally increase audio settings while filtering background noise.

2. Description of the Related Art

Various types of ear buds and in-the-ear devices are manufactured in the prior art. Ear buds are used in various applications ranging from use in hearing aids, in high end systems typically used by professionals in the television, radio or music industry, and in commercially sold ear buds available for every use in conjunction with portable music players, telephones or other handheld devices.

Such existing universally adaptable ear buds typically fall out of the ear canal or cause discomfort. Improved versions rely on a deep and tight insertion into the ear canal to keep the device in the ear and prevent it from falling out. This type of deep and tight insertion technique tends to result in painful rubbing of the ear buds inside the ear canal and can also seal the ear canal. As a result, the user can experience irritation and discomfort, particularly after long uninterrupted use. Further, completely sealing the ear canal from the user's environment may have dangerous implications. It may affect a user's ability to hear ambient sound by reducing the intensity of the sound, and it may alter the user's ability to localize sound, particularly in the high frequencies where interaural sound pressure differences are the primary cue for localization. Also, even with the tight seal these devices continue to fall out of the ear canal due to their shape and the material from which they are made.

Many prior art devices are sold purely as ear bud adapters, without any internal electronics for the transmission of sound. Most commercially sold ear buds consist of an audio device implanted into a typically round plastic core with a rubberized shell. An example of a prior art ear bud adapter can be found in U.S. Pat. No. 5,659,156 issued to Mauney et al. ("Mauney"). Mauney discloses an ear bud adapter designed to minimize protrusion into the ear canal by providing a protrusion helix of the ear bud to fit under the crus of the ear's helix. This device is deficient however in that the balance of the device weight is outside the user's ear tending to cause the ear buds to slip out of the ear, particularly during physical activity such as running.

In addition, in-the-ear hearing aids used for people who have hearing loss are typically made in a skin tone color in order to blend into the wearer's ear. In reality, such devices stand out and can result in an awkward looking appearance. Such designs have in past resulted in a negative stigma being associated with hearing aid devices as they are not fashionable and tend to look like machinery. Such devices can negatively affect the self-esteem of hearing impaired people, and in particular children. Therefore placing a device in-the-ear canal that looks like a hearing aid also can have those associations.

Moreover, prior art universal ear buds, when used in conjunction with portable music devices, tend to require high decibel audio settings in order for music to be heard clearly. Such devices typically have poor acoustics and do not filter out interfering ambient noises thus requiring the need for ever louder audio settings. Of course such high level audio settings are proposed to be a leading cause of hearing loss in the general population.

Several high end ear buds have been developed for professionals requiring sound in their ears without bulky headsets. Television and music industry people routinely apply these solutions. Unfortunately the technology applied to these high technology solutions is costly and not a reasonable solution for a general public commercial release because they require custom made ear molds that fit only one individual.

In light of the above current prior art deficiencies a new and improved in-the-ear device shape is needed that provides the wearer with added fit and comfort without completely sealing off the wearer's ear from ambient noise. In addition there exists a need for new and improved in-the-ear device that remains situated in the wearer's ear especially during physical activity. Furthermore, there is a need for a new and improved in-the-ear device that removes the present negative stigma of hearing aid devices. Additionally there is a need for a more fashionable and fully functional in-the-ear device for use with universal audio devices that can help remove the stigma of in-the-ear hearing aids. Finally, a new and improved in-the-ear device is needed for universal fit so that production costs can be reduced such that sale to the general public can be accomplished at a reasonable per unit cost.

SUMMARY OF THE INVENTION

The present invention is directed to an in-the-ear device sized and shaped such that it ergonomically and universally fits into the human ear without slipping out and providing the user with a comfortable fit.

It is an object of this invention to provide an in-the-ear device which is secured in the user's ear by taking advantage of the elasticity and natural curvature of the human ear to provide support and shift the center of gravity of the device from outside the ear to further inside the auricle and ear canal. This will prevent the device from slipping out while retaining a high level of comfort.

It is a further object of this invention to provide an in-the-ear device adaptable for various sound producing hardware devices while securing them in the user's ear.

It is also an object of the present invention to provide an in-the-ear device which provides for improved acoustics by removing the need to increase the volume of any audio device adapted thereto, thereby possibly preventing hearing loss.

It is a further object of the present invention to provide an in-the-ear device which isolates electrical components from the skin of the wearer.

The invented in-the-ear device gains a stable mounting platform at the ear opening by using an extended helix of the in-the-ear device to allow it to fit under the crus of the helix of the ear and partially into the auditory canal. This configuration, combined with the placement of an adapted audio component further into the device, shifts its center of gravity more medially into the user's ear, taking further advantage of the natural shape of the ear to secure the in-the-ear device in a comfortable manner even during physical activity.

Another feature of the improved in-the-ear device includes the profile which follows the natural shape of the ear canal. By following the curvature of the ear canal, the wearer's comfort is greatly improved.

Additionally, the invented in-the-ear device is made from a material that amplifies sound in such a way to clarify any audio device adapted thereto while retaining the ability of the wearer to hear ambient notices. Such a device allows a wearer retain the ability to localize sound.

Additionally, it is an object of the present invention to provide an in-the-ear device that removes the stigma associated with prior art hearing aid devices. In this manner, the present invention may be made from materials and with colors and designs that allows wearers to increase the attractiveness of the device. Specifically with children, the color and design may become personal in nature and provide the wearer with an identity in order to remove the stigma associated with hearing aids.

In a first aspect, the present invention is directed to an in-the-ear device having a size and shape to fit the majority of human ears including a main body portion or housing with a sound channel bored therein and acoustically connected to a sound port directed into the wearer's auditory canal. More specifically the present invention is directed to an improved in-the-ear device, suitable for wearing in the user's outer ear, the ear having a helix, a crus, and an antitragus, the ear bud device having a main body portion molded to fit within the user's outer ear, having a first side distal to the user, a first bend, a bottom portion, a second bend, and a second side medial to the user, the bottom portion connected by the first bend in-the-ear bud device to the first side, and the second side connected by the second bend in-the-ear bud mold to the bottom portion, the main body portion have a cavity therein, the cavity structured and arranged to receive a sound producing device, a first protuberance 25 extending from said first side for supporting the bud in place within the user's ear, the supporting of the in-the-ear device in place within the user's ear being accomplished by the combination of positioning said first protuberance within the user's outer ear and under the crus of the helix of the user's outer ear and locating the cavity in a position within the main body portion such that when a sound producing device is placed within the cavity the center of gravity of the in-the-ear device is positioned such that it remains situated in the wearer's ear, and a second protuberance 20 extending from the second side having about the same size as the user's ear canal such that the second protuberance does not sealingly engage the ear canal, the second protuberance having a bore, the bore being in gas communication with the cavity.

In some embodiments the in-the-ear device includes at least one alignment mark placed on the first side and below the first protuberance, for positioning of the sound producing device within the cavity.

In some embodiments the in-the-ear device is made from an electrical insulating material.

In some embodiments the in-the-ear device includes a notch located in the bottom portion to provide contact relief to the user's antitragus.

In some embodiments the in-the-ear device is made from a material that is rigid.

In some embodiments the cavity and the sound bore are structured and arranged to amplify sound from a sound producing device located within the cavity without causing damage to the wearer's ear drum.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE PREFERRED EMBODIMENTS

Figure 1:
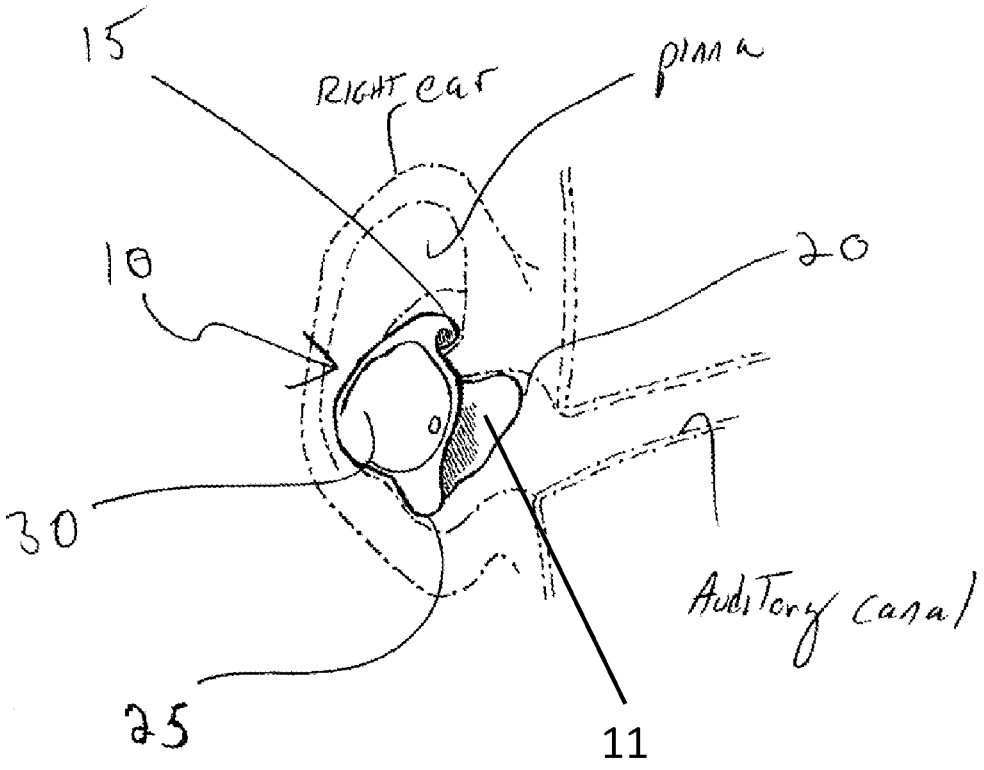
FIG. 1 shows a right ear view of the in-the-ear device inserted into a user's right ear.

The present disclosure will now be described more fully with reference to the Figures in which an embodiment of the present disclosure is shown. The subject matter of this disclosure may, however, be embodied in many different forms and should not be construed as being limited to the embodiments set forth herein. For example, the in-the-ear device can include hearing aids, including tinnitus devices; wireless audio devices, such as Bluetooth devices and surveillance listening devices; electronic fluency devices (stuttering devices); and combinations thereof.

The outer ear is the external portion of the ear, which consists of the pinna, concha, and auditory meatus and canal. It gathers sound energy and focuses it on the eardrum (tympanic membrane). One consequence of the configuration of the external ear is to selectively boost the sound pressure 30- to 100-fold for frequencies around 3000 Hz. This amplification makes humans most sensitive to frequencies in this range and also explains why they are particularly prone to acoustical injury and hearing loss near this frequency. Most human speech sounds are also distributed in the bandwidth around 3 kHz.

The pinna provides protection for the middle ear in order to prevent damage to the eardrum. The outer ear also channels sound waves which reach the middle ear through the ear canal to the eardrum. Because of the length of the ear canal, it is capable of amplifying sounds with frequencies of approximately 3000 Hz. As sound travels through the outer ear, the sound is still in the form of a pressure wave, with an alternating pattern of high and low pressure regions. It is not until the sound reaches the eardrum at the interface of the outer and the middle ear that the energy of the mechanical wave becomes converted into vibrations of the bones of the middle ear.

The middle ear is medial to the pinna. It is an air-filled cavity which consists of an eardrum and three tiny, interconnected bones—the malleus, incus, and stapes. The eardrum is a very durable and tightly stretched membrane which vibrates as the incoming pressure waves reach it. As shown below, a compression forces the eardrum inward and a rarefaction forces the eardrum outward, thus vibrating the eardrum at the same frequency as the sound wave.

Overall, the present invention provides an in-the-ear device, suitable for wearing in a user's outer ear, the in-the-ear device including: a main body portion or housing with a first side distal to the user, a second side medial to the user, a center of gravity, and a sound channel acoustically directed into the user's auditory canal; the sound channel having a cavity to receive a sound producing device; and the cavity having a depth of about 0.10 inches, thus positioning the center of gravity of the ear device closer to the second side and more medial to the user, thereby providing an in-the-ear device that remains situated in the user's ear during physical activity. The depth of the cavity of the present invention is a functional means to shift the center of gravity inward. The device would not have the same ability to stay in the ear if the cavity were much deeper. The reduction in size of the cavity is not to provide less weight and therefore increased comfort, but rather to shift the center of gravity.

In preferred embodiments, the device further includes a first protuberance that fits under the crus of the helix of the user's ear, and a second protuberance that extends into the user's ear canal but does not sealingly engage the ear canal. Also, preferably, the device further includes at least one alignment mark placed on the first side and below the first protuberance, for positioning of the sound producing device within the cavity. Additionally, the device includes a notch that provides contact relief to the user's antitragus. Advantageously, the center of gravity location, combined with the size and shape of the device, cavity and protuberance(s), securely retain the placement in the user's ear until intentional extraction or removal by the user. Thus, the present invention provides a non-custom, in-the-ear device for improving hearing, wherein the device is removably insertable into the user's ear such that the device remains in place after insertion, even during physical activities, and is removable by the user as desired.

The present invention thus includes a hearing enhancement device including: a body housing constructed and configured for insertion into a human ear of a user, the body housing having a first side distal to the user, a second side medial to the user, a center of gravity of the device, and a sound channel acoustically directed into the user's auditory canal; the sound channel having a cavity to receive a sound producing device, wherein when the body housing is removably inserted into the human ear, the center of gravity of the device is positioned closer to the second side, thereby providing an in-the-ear device that remains situated in the user's ear during physical activity. The device further includes a first protuberance that fits under the crus of the helix of the user's ear; at least one alignment mark placed on the first side and below the first protuberance, for positioning of the sound producing device within the cavity; a notch that provides contact relief to the user's antitragus; a second protuberance that extends into the user's ear canal but does not sealingly engage the ear canal; and wherein the cavity has a depth of about 0.10 inches. The device is preferably made from an electrical insulating material and may also be made from a rigid material. The cavity and the sound bore are constructed and configured to amplify sound from a sound producing device located within the cavity without causing damage to the user's ear drum. The device is selected from the group consisting of hearing aids, tinnitus devices, wireless audio devices, electronic fluency devices, and combinations thereof.

Thus, the present invention teaches a gravity-based approach to holding the device in the ear. This differs from the prior art, which does not describe the use of gravity or adjustment of the center of gravity of the device to hold the device in the ear. Rather, the prior art relies on friction and/or the crux of the helix to hold the device in place. For example, the prior art teaches twisting the device to engage the helix of the device with the helix of the ear and/or inserting the device snugly enough that the contact friction between the device and the ear canal prevents the device from falling out.

Thus, the present invention provides an in-the-ear device that does not fall out of the ear canal and does not cause discomfort. It does not require deep and tight insertion to keep the device in the ear and thus does not seal the ear and eliminates painful rubbing, thus reducing irritation and discomfort. The present invention does not seal the ear, thereby not eliminating the user's ability to hear ambient sound or the ability to localize sound. Because the device is less conspicuous than prior art devices, it is less likely to negatively affect the self-esteem of the user. The present invention does not require high decibel audio setting in order to function properly. The present invention is thus a less costly solution for general public commercial use because it provides the necessary performance without requiring customization.

Figure 2:
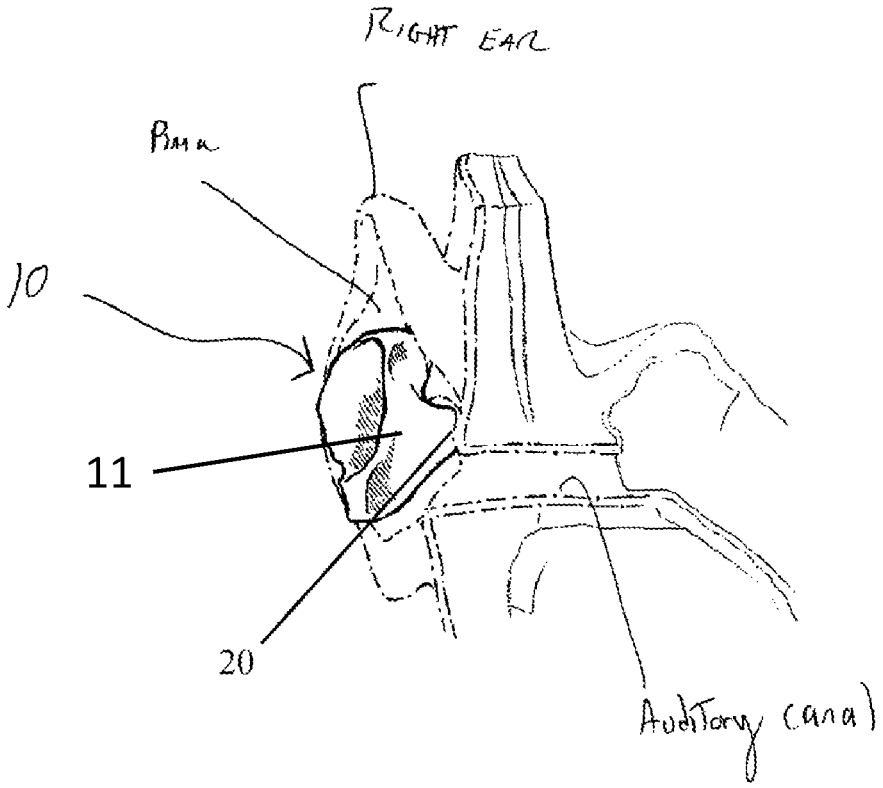
FIG. 2 shows the in-the-ear device of FIG. 1 ear from a partial front side view.

Referring now to FIG. 1 there is shown a side view of a wearer's ear with the in-the-ear device 10 in place. Auditory canal portion 20 is preferably placed slightly into the auditory canal while protuberance 15 is positioned in the conchal bowl and protuberance 25 is positioned under the crus in the helix. Cavity 30 is shown without a sound producing device inserted therein, however the combination of the cavity 30 in the main body portion 11 along with an inserted audio device provides for the center gravity of the device further into the wearer's ear. Hence the device is secured better in the wearer's ear. Referring now FIG. 2 there is shown the in-the-ear device of FIG. 1 from a cut away aside view. As can be seen auditory canal portion 20 is slightly elongated medially such that it inserts into the auditory canal, thus shifting the center of gravity of the in-the-ear device medially to maintain the device in the wearer's ear. It has been found that this configuration provides support for the device even during physical activity such as running while maintaining a high level of comfort.

Referring now to FIGS. 3A-3E the in-the-ear device is shown from various views. Cavity 30 is in gas communication with orifice 21 via bore 22 such that sound from and inserted audio device may exit orifice 21 and enter into the wearer's auditory canal. The anatomical shape of various portions of device 10, including protuberance 25 and protuberance 15, ensures that device 10 fits the ears of a great majority of the entire adult human population. Notch 17, located between protuberances 15 and 20, is shaped to engage just under the helix of the outer ear.

It has been found that the human outer ear is as unique as a finger print but the auricle is elastic. Taking advantage of this elasticity, the present invention advantageously fits most of the population without requiring customization of the outer part of the housing. So the device of the present invention provides a general or generic outer shape and size that fits most adult human ears for insertion therein, and so the device may be mass produced to reduce the per-unit cost making the device, thus improving affordability and efficiency of time and cost by not requiring customization, while providing a consistent fit and feel. Preferably, the device is made from a solid material that is electrically insulated. Such materials may include porcelain, plastic, vulcanized rubber or other similar material. A solid device is suitable because the outer ear is made from flexible human tissue (cartilage). Such flexibility allows for a solid, naturally shaped device to fit comfortably while providing clear audio. Also, preferably, the device housing is made from a rigid material.

Figures 3A, 3B, 3C, 3D, 3E:
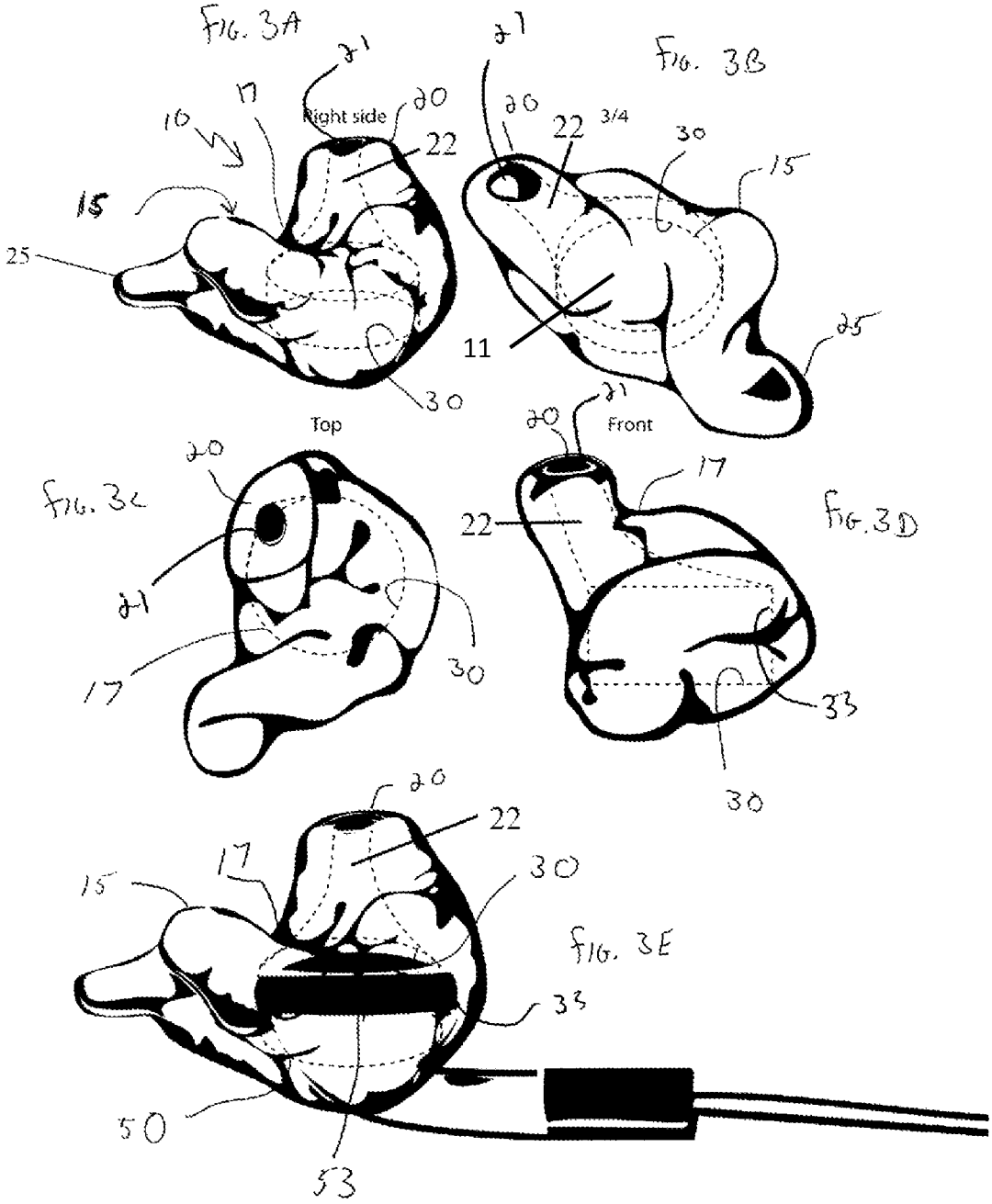
FIGS. 3A-3E show the in-the-ear device from various views according one embodiment of the present invention.

FIG. 3E shows an example of the in-the-ear device with a consumer portable speaker plug 50 inserted into cavity 30. Cavity 30 preferably includes sides 33 having a rough surface such that when engaged with ear phone outer surface 53 there is a friction fit. In some embodiments surface 33 includes locking ridges to permanently engage and secure an audio device. In still other devices surface 33 includes threads or snap fit type junction to releaseably engage an audio device. In addition, an audio device may be encased in the in-the-ear device so that it is manufactured as one piece.

Cavity 30 is shown with a round cross sectional shape having a diameter of about 0.25 inches. The depth of cavity 33 preferably is about 0.10 inches. However it is understood that cavity 30 may have other shapes and sizes to adapt to the market.

Figures 4A, 4B:
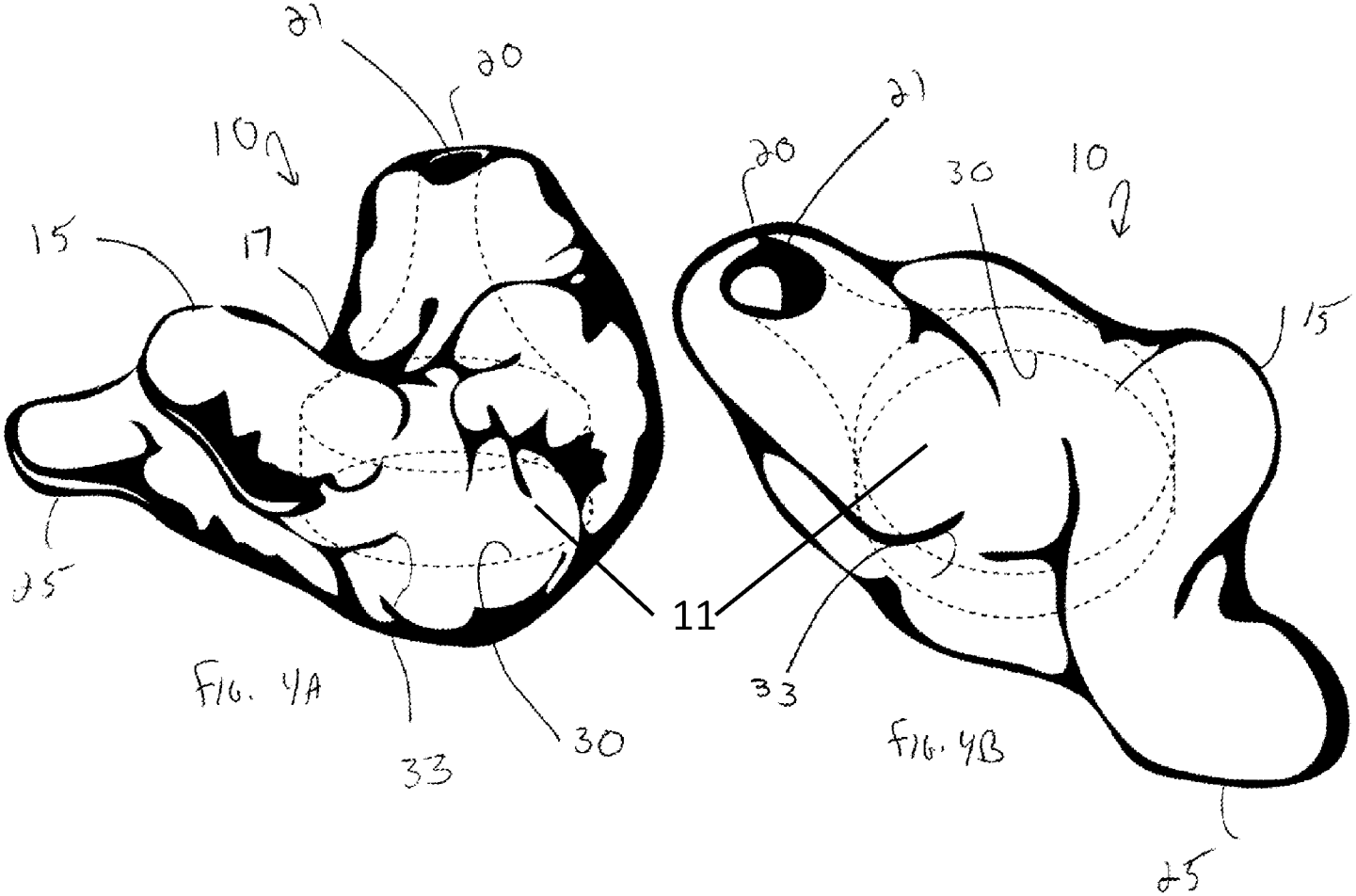
FIGS. 4A-4B show an enlarge view of the in-the-ear device shown in FIGS. 3A and 3B according to one embodiment of the present invention.
Figures 5A, 5B, 5C, 5D, 5E, 5F:
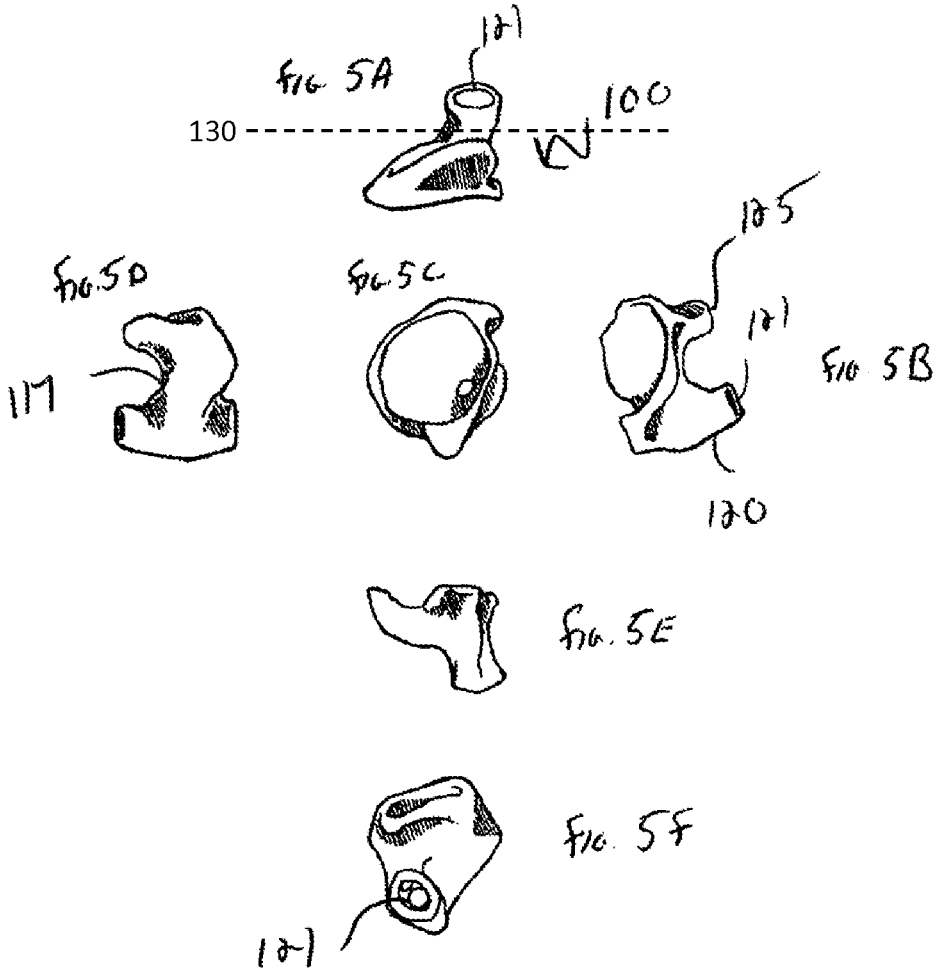
FIGS. 5A-5F show the in-the-ear device from various views according another embodiment of the invention.

FIGS. 4A and 4B show enlarged views of the in-the-ear device as shown in FIGS. 3A and 3B.

FIGS. 5A-5F show an alternative design for the in-the-ear device 100 in views from all sides of the device. Device 100 similarly includes an auditory canal portion 120 with notch 117 and upper protuberance 125. The auditory canal portion 120 includes an orifice 121. When placed in a wearer's ear the auditory canal portion 120 is inserted into the auditory canal such that the sound traveling out of orifice 121 is unobstructed while background noise is not entirely filtered. In this connection the wearer will be able to hear clear sound without requiring a loud sound level from an inserted audio device and without being sealed from outside sound.

In another embodiment, the device is designed and constructed so that the center of gravity of the device is located in the auditory canal portion 20, thus positioning the center of gravity within the auditory canal of the user when the device is in use. Positioning the center of gravity inside the auditory canal helps secure the device in the ear because the device will tend to tilt medially, into the user's ear, rather than away from the ear. The center of gravity 130 is shown thus positioned in FIG. 5*a*.

It will be apparent to one of skill in the art that described herein is a novel system and method for automatically modifying a language model. While the invention has been described with reference to specific preferred embodiments, it is not limited to these embodiments. The invention may be modified or varied in many ways and such modifications and variations as would be obvious to one of skill in the art are within the scope and spirit of the invention and are included within the scope of the following claims.

The invention claimed is:

1. An in-the-ear device, suitable for wearing in a user's outer ear, the in-the-ear device comprising: a main body portion with a first side distal to the user, a second side medial to the user, a center of gravity, and a sound channel acoustically directed into the user's auditory canal; the sound channel having a cavity to receive a sound producing device; and the cavity having a depth of about 0.10 inches, thus positioning the center of gravity of the ear device closer to the second side and more medial to the user, thereby providing an in-the-ear device that remains situated in the user's ear during physical activity.

2. The in-the-ear device of claim 1, further including a first protuberance that fits under the crus of the helix of the user's ear.

3. The in-the-ear device according to claim 2, further comprising at least one alignment mark placed on the first side and below the first protuberance, for positioning of the sound producing device within the cavity.

4. The in-the-ear device of claim 1, further including a notch that provides contact relief to the user's antitragus.

5. The in-the-ear device of claim 1, further including a second protuberance that extends into the user's ear canal but does not sealingly engage the ear canal.

6. The in-the-ear device according to claim 1, wherein the in-the-ear device is made from an electrical insulating material.

7. The in-the-ear device according to claim 1, where the in-the-ear device is made from a solid material.

8. The in-the-ear device according to claim 1, where the cavity and the sound channel are structured and arranged to amplify sound from a sound producing device located within the cavity without causing damage to the user's ear drum.

9. The in-the-ear device according to claim 1, wherein the in-the-ear device is selected from the group consisting of: hearing aids; tinnitus devices; wireless audio devices; electronic fluency devices; and combinations thereof.

10. A hearing enhancement device comprising: a body housing constructed and configured for insertion into a human ear of a user, the body housing having a first side distal to the user, a second side medial to the user, a center of gravity of the device, and a sound channel acoustically directed into the user's auditory canal; and the sound channel having a cavity to receive a sound producing device, wherein when the body housing is removably inserted into the human ear the center of gravity of the device is positioned closer to the second side, thereby providing an in-the-ear device that remains situated in the user's ear during physical activity.

11. The device of claim 10, further including a first protuberance that fits under the crus of the helix of the user's ear.

12. The device of to claim 11, further comprising at least one alignment mark placed on the first side and below the first protuberance, for positioning of the sound producing device within the cavity.

13. The device of claim 10, further including a notch that provides contact relief to the user's antitragus.

14. The device of claim 10, further including a second protuberance that extends into the user's ear canal but does not sealingly engage the ear canal.

15. The device of to claim 10, wherein the body housing is made from an electrical insulating material.

16. The device of to claim 10, where the body housing is made from a rigid material.

17. The device of to claim 10, where the cavity and the sound channel are constructed and configured to amplify sound from a sound producing device located within the cavity without causing damage to the user's ear drum.

18. The device of to claim 10, wherein the device is selected from the group consisting of hearing aids; tinnitus devices; wireless audio devices; electronic fluency devices; and combinations thereof.

19. The device of claim 10, wherein the center of gravity is located in an auditory canal portion.

* * * * *